US006439121B1

(12) United States Patent
Gillingham

(10) Patent No.: US 6,439,121 B1
(45) Date of Patent: Aug. 27, 2002

(54) PERFORATING CHARGE CARRIER AND METHOD OF ASSEMBLY FOR SAME

(75) Inventor: Kevin Alan Gillingham, Joshua, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 49 days.

(21) Appl. No.: 09/589,954

(22) Filed: Jun. 8, 2000

(51) Int. Cl.[7] ..... F42B 3/00; C06C 5/04

(52) U.S. Cl. ..... 102/312; 102/313; 102/320; 102/332; 102/275.7; 102/275.8; 102/275.12

(58) Field of Search ..... 102/312, 313, 102/319, 320, 321, 331, 332, 275.7, 275.8, 275.12

(56) References Cited

U.S. PATENT DOCUMENTS

| | | | | | |
|---|---|---|---|---|---|
| 1,652,961 | A | * | 12/1927 | Snelling | 102/275.7 |
| 2,756,677 | A | | 7/1956 | McCullough | 102/20 |
| 2,764,938 | A | | 10/1956 | Harcus | 102/20 |
| 2,837,997 | A | * | 6/1958 | Woods | 102/321 |
| 3,444,810 | A | | 5/1969 | Hakala | 102/20 |
| 3,455,242 | A | * | 7/1969 | Slawinski | 102/275.5 X |
| 4,312,273 | A | | 1/1982 | Camp | 102/310 |
| 4,326,462 | A | | 4/1982 | Garcia et al. | 102/310 |
| 4,424,747 | A | * | 1/1984 | Yuwan | 102/275.7 X |
| 4,479,556 | A | | 10/1984 | Stout et al. | 175/4.6 |
| 4,583,602 | A | | 4/1986 | Ayers | 175/4.52 |
| 4,716,833 | A | * | 1/1988 | Regalbuto | 102/312 X |
| 4,716,963 | A | | 1/1988 | George et al. | 166/123 |
| 4,832,134 | A | | 5/1989 | Gill | 175/4.6 |
| 4,844,170 | A | | 7/1989 | Gill | 166/297 |
| 4,875,413 | A | * | 10/1989 | Christopher et al. | 102/313 X |
| 4,885,993 | A | * | 12/1989 | Hancock et al. | 102/313 X |
| 4,951,744 | A | * | 8/1990 | Rytlewski | 102/313 X |
| 5,070,943 | A | | 12/1991 | Walker et al. | 166/297 |
| 5,701,964 | A | * | 12/1997 | Walker et al. | 102/321 X |
| 6,006,671 | A | * | 12/1999 | Yuwan | 102/275.11 |
| 6,244,157 | B1 | * | 6/2001 | Tseka | 102/312 X |

OTHER PUBLICATIONS

Catalog, JRC Scalloped Gun Perforating Systems, Jet Research Center, Jun. 1999.

* cited by examiner

*Primary Examiner*—Peter A. Nelson
(74) *Attorney, Agent, or Firm*—Paul I. Herman; Russel N. Rippamonti

(57) ABSTRACT

A tubular charge holder assembly for a perforating gun made of a tube having a plurality of pairs of diametrically opposed openings. The pairs of openings are formed over a length of the tube, wherein the each pair has a larger and a smaller opening. A shaped charge is located within the pairs of openings in the tubular charge holder so that at least a portion of the rim of a front face of the shaped charge extends out of the larger opening and at least a portion of a rear face of the shaped charge extends out from the smaller opening of the tube. A detonating cord is helically wrapped around the outside surface of the tube such that the detonating cord is positioned so that the cord is proximate to the rear surface of each of the shaped charges installed within the tube. A substantially semi-circular clip is positioned on the outside surface of the tube proximate each of the shaped charges. Each clip includes first hook on a first end and a second hook on a second end on the front of the clip for engaging at least two portions of the rim surrounding the front face of the shaped charges. On a back of the clip, the clip has a retainer, such as a U-shaped portion or snap device to secure the detonating cord proximate to the rear surface of the shaped charge. The retainer may be perpendicular to a longitudinal axis of the clip or may be angled or offset with respect to the longitudinal axis of the clip to accommodate the helically wrapped detonating cord. The clip may be a wire, a pair of wires, a band, a perforated band having a adjuster or other suitable configurations.

70 Claims, 4 Drawing Sheets

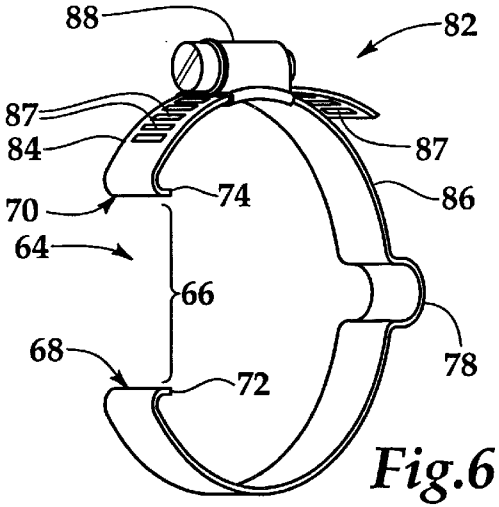
Fig.6
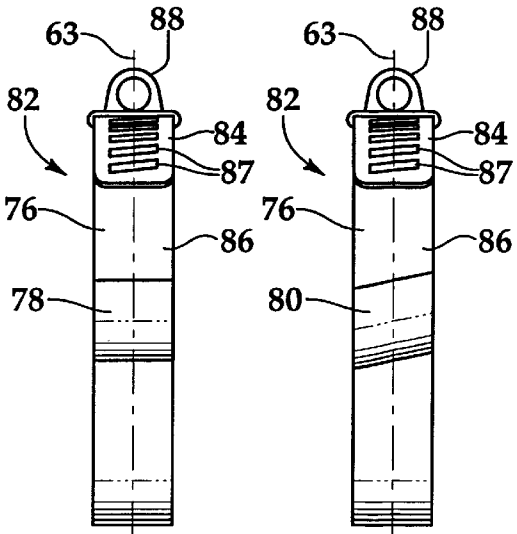
Fig.6B
Fig.6A
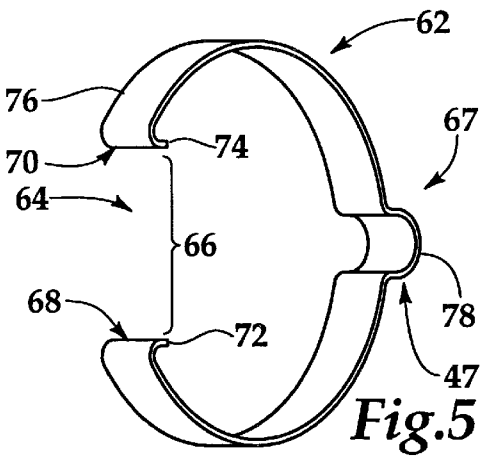
Fig.5
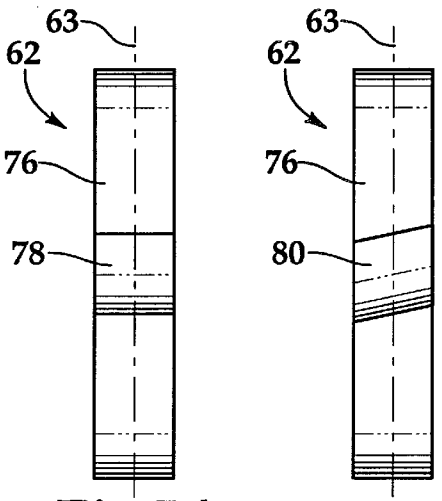
Fig.5B
Fig.5A
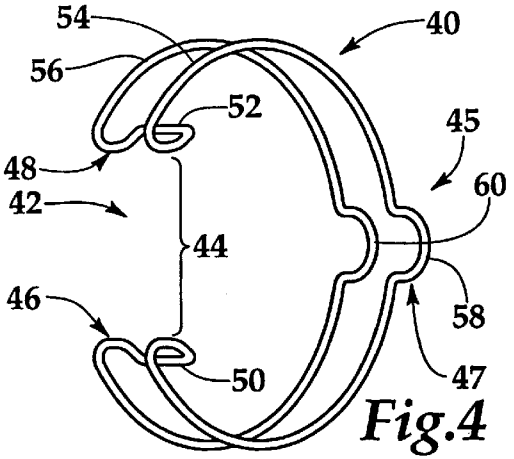
Fig.4
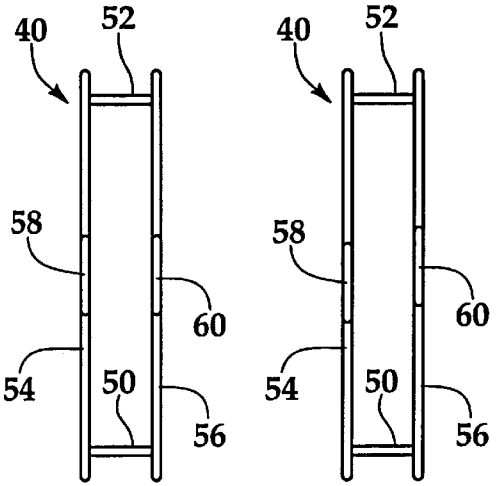
Fig.4B
Fig.4A

PERFORATING CHARGE CARRIER AND METHOD OF ASSEMBLY FOR SAME

TECHNICAL FIELD

The invention relates to a carrier assembly for shaped charges for use in a perforating gun of the type generally used to perforate oil and gas wells and method of assembling same. More particularly, the invention relates to an improved retaining clip for holding a detonating cord adjacent a rear end of a shaped charge and for securing the shaped charge in place within a carrier assembly in a perforating gun.

BACKGROUND ART

In a common embodiment, perforating guns may be comprised of a closed, fluid-tight reusable or expendable hollow carrier gun body adapted to be lowered on a wire line or tubing conveyed into a well bore. In an expendable type hollow carrier gun, a tubular charge holder (hereinafter referred to as the "tubular charge holder"), is disposed within the hollow carrier gun body. A plurality of shaped explosive charges (hereinafter "shaped charges") are disposed in the tubular charge holder in a selected spatial distribution. A detonating means, such as a detonating cord, is positioned adjacent to the rear of the shaped charges. The shaped charges have conically constrained explosive material therein. The shaped charges are typically distributed over the length of the gun. Detonation of the charges can be activated electronically or mechanically depending upon the technique used for lowering the perforating gun in the well bore. The detonating means is activated from the surface when the perforating gun has been positioned in the well bore adjacent to a subterranean formation to be perforated.

In a closed, fluid-tight type of gun body, the explosive jets produced upon detonation of the shaped charges penetrate the hollow carrier gun body before penetrating the casing wall of the well bore and the adjacent formation. To reduce the resistance produced by the hollow carrier gun body and increase the depth of perforation penetration into the formation, the perforating gun body may be provided with external recesses or scallops that leave relatively thin wall portions through which the explosive jets pass. The scallops in the hollow carrier gun body must be positioned in a spatial distribution that corresponds to the spatial distribution of the shaped charges held within the gun body by the tubular charge holder.

In an expendable hollow carrier gun, the tubular charge holder may be formed from thin walled tubes of metal, cardboard, plastic or other materials having openings cut into the tube wall for receiving the shaped charge.

Frequently, but in not all cases, it is desirable to produce a shot pattern that emanates in various directions from the gun. This is known in the art as shot phasing. Phasing may range from 0E (all shots in alignment) to any choice of shot pattern. Typical shot phasing may be spaced at 45E, 60E, 90E or 120E. To produce a shot pattern emanating in various directions, the charges are usually circumferentially offset, i.e., the discharge end of each successive shaped charge is laterally spaced from a preceding charge whereby the discharge ends of the charges as well as the corresponding external recesses or scallops in the hollow carrier gun body lie on a helical path. The successive detonation of the charges along the helical path produces a shot pattern and perforations around and over the length of the gun.

In an expendable hollow carrier type gun, the shaped charges must be secured in the tubular charge holder and the detonating cord used to detonate the shaped charges must be retained in contact with the center of the rear surface of each shaped charge to assure that the shaped charge is detonated. Retaining clip type structures have been utilized with shaped charges to hold a detonating cord and/or to hold the shaped charge in place relative to the tubular charge holder. For example, U.S. Pat. No. 4,312,273 to Camp discloses a shaped charge mounting system including a spring wire clip 30 which holds the shaped charge in place and which includes arms which aid in holding a detonating cord. U.S. Pat. No. 3,444,810 to Hakala discloses a shaped charge assembly including a swivel clamp base 38 which has a pair of resilient prongs 40 for holding a detonating cord. U.S. Pat. Nos. 4,479,556 to Stout et al., 4,326,462 to Garcia et al. and 2,756,677 to McCullough disclose shaped charge holder assemblies including various types of attachment means for holding the shaped charge in place a tubular charge holder. U.S. Pat. Nos. 4,583,602 to Ayers and 2,764,938 to Harcus both disclose tubular type charge holder assemblies in which shaped charges are held within pairs of diametrically opposed circular openings in the tubular charge carrier. U.S. Pat. No. 4,832,134 to Gill discloses a retaining clip operably associated with a flange on a rearward end of a shaped charge for retaining the shaped charge within a tubular type charge holder in which shaped charges are held within pairs of diametrically opposed circular openings in the tubular charge carrier.

In commonly used prior art reusable ported type hollow carrier gun bodies, the basic shaped charges are typically not held in a tubular charge carrier. The shaped charges typically have a flat rear surface and are inserted from one end of the hollow carrier with a special tool to a location proximate a ported opening. The front face of the shaped charge is directed out of the ported opening. A detonating cord runs inside of the hollow carrier gun body for detonating the shaped charges. The shaped charge typically includes a polymeric sleeve surrounding the exterior of the charge used for holding the detonating cord proximal to the rear of the charge. An alignment washer (face cover) is disposed over the front of the charge. A threaded plug is screwed into the ported opening and contacts the face cover of the charge to secure the shaped charge in place within the hollow carrier gun body.

A need exists for a reliable and economical tubular charge holder assembly for use with an expendable type hollow carrier perforating gun that further includes a less expensive basic shaped charge. The present invention provides a reliable clip for both securing a less expensive basic shaped charge in a tubular charge holder used internally in a hollow carrier gun and concurrently securing the detonation cord in proximity to the center point of the rear surface of the shaped charge.

SUMMARY OF THE INVENTION

A tubular charge holder assembly made of an expendable tube having a plurality of forward openings and a plurality of corresponding rear openings that are diametrically opposed from the forward openings. The openings are formed over a length of the tube, wherein the forward openings are larger than the rearward openings. In one embodiment, the forward and rearward openings may be angularly offset from corresponding forward and rearward openings immediately above and below. In an alternate embodiment having OE shot phasing, the forward openings may be in alignment with one another and the rearward openings in alignment with one another. Shaped charges are located within the openings in tubular charge holder. The shaped charges have a case having a rim surrounding a front face and having a rearward end having a rear face with a center point. The shaped charge contains a shaped explosive and a cone within the case. The shaped charge is held within the tubular charge holder so that a portion of a rim on the front face is accessible proximate the forward opening of the tubular charge holder and at least a portion of the rear face is accessible proximate the rearward opening of the tubular charge holder.

A detonating cord is wrapped around the expendable tube of the tubular charge holder such that the detonating cord traverses the length of the tube and helically wraps around the tube. The detonating cord is positioned so that it is proximate to the rear surface of each of the shaped charges. The detonating cord may be wrapped around the outside of the tube. Alternatively, the detonating cord may pass on the inside of the tube when traversing from charge to charge and pass outside the tube when disposed across the rear face of the charge. A substantially semi-circular clip is positioned on the outside of the tube partially surrounding the tube. The clips have a first hook on a first end and a second hook on a second end on the front of the clip. On the back of the clip, the clip has a retainer, such as a U-shaped portion or snap device to secure the detonating cord. The retainer may be perpendicular to the clip or may be angled or offset with respect to the clip to accommodate the helically wrapped detonating cord. The clip may be made of a wire, a pair of wires, a band, a perforated band having a adjuster or of other suitable configurations.

BRIEF DESCRIPTION OF THE DRAWINGS

FIG. 4 is a perspective view of a two-wire clip used with the tubular charge holder of FIG. 1.

FIG. 4*a* is an end view of the two-wire clip of FIG. 4.

FIG. 4*b* is an end view of an alternate embodiment of the two-wire clip of FIG. 4.

FIG. 5 is a perspective view of a band clip for use with the tubular charge holder of FIG. 1.

FIG. 5*a* is an end view of the band clip of FIG. 5.

FIG. 5*b* is an end view of an alternate embodiment of the band clip of FIG. 5.

FIG. 6 is a perspective view of an alternate embodiment of the band clip of FIG. 5.

DETAILED DESCRIPTION OF THE INVENTION

Figure 1:
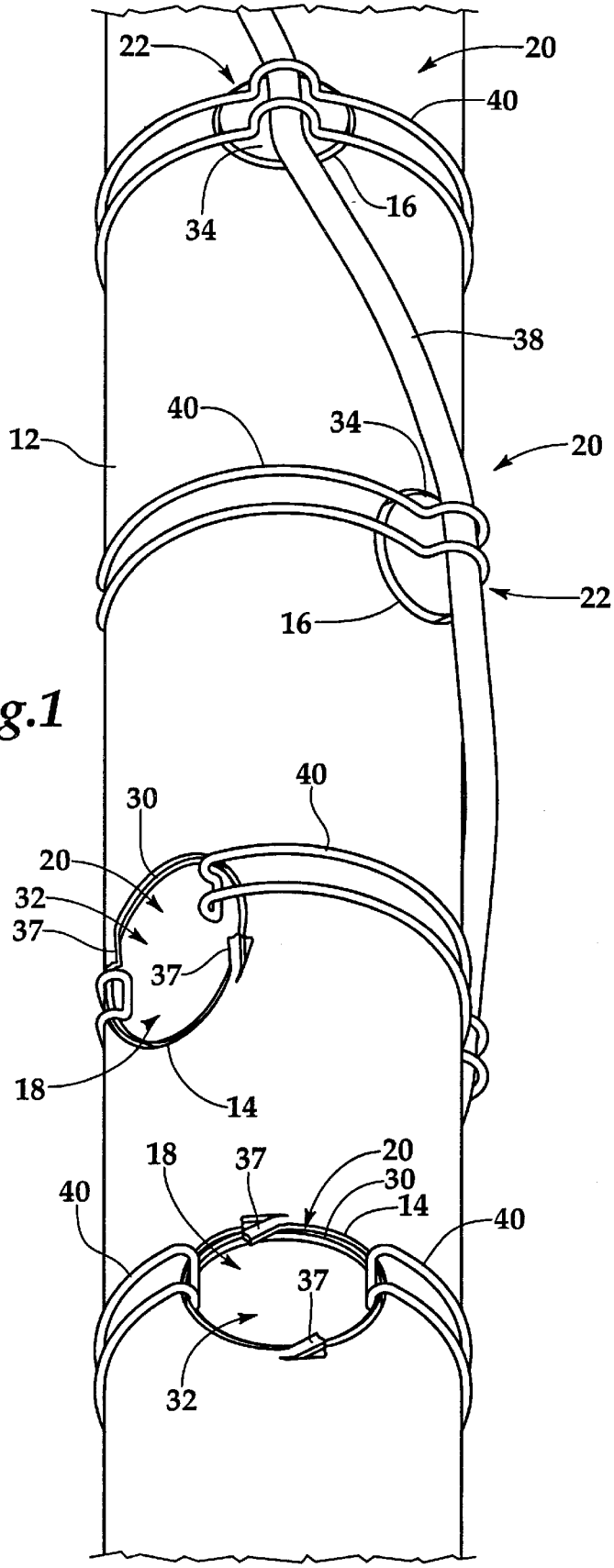
FIG. 1 is perspective view of the tubular charge holder assembly of the present invention having a 90E shot phasing.

Reference is now made to the Drawings wherein like reference characters denote like or similar parts throughout the Figures. Referring now to FIG. 1, a tubular charge holder assembly designated generally 10 is shown. Tubular charge holder assembly 10 includes an expendable tube 12 that may be made of metal, cardboard, plastic or other suitable material. Tube 12 has a plurality of openings formed therein. The openings preferably are diametrically opposed relatively larger forward openings 14 and relatively smaller rearward openings 16. Typically, the openings 14, 16 are arranged over a length of tube 12 such that adjacent forward openings 14 and adjacent rearward openings 16 are radially offset by a desired phasing amount, such as a 60E or 90Eoffset. The result is that the openings 14, 16 face outwardly in a spiral pattern over the length of tube 12. However, in an alternate embodiment (with 0E phasing not depicted) all forward openings may be in alignment and all the rearward openings may be in alignment.

Figure 2A:
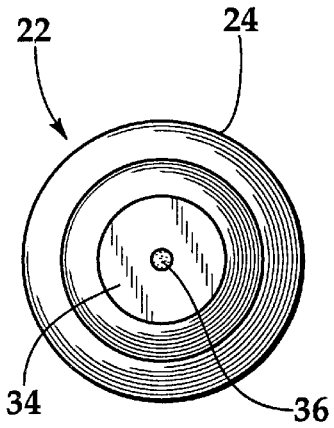
FIG. 2 is a front, side and rear elevational view of a typical shaped charge for use with the tubular charge holder assembly of FIG. 1.
Figure 2B:
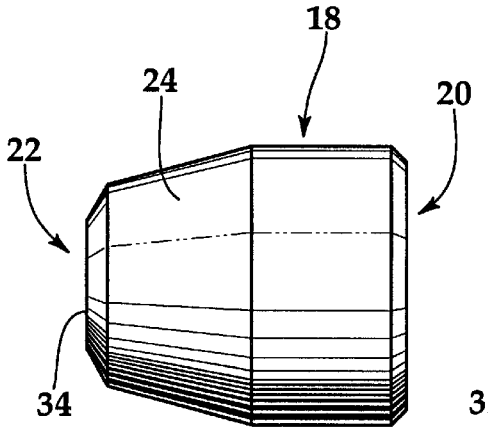
Figure 2C:
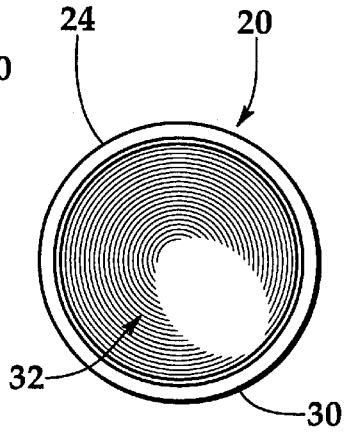
Figure 3:
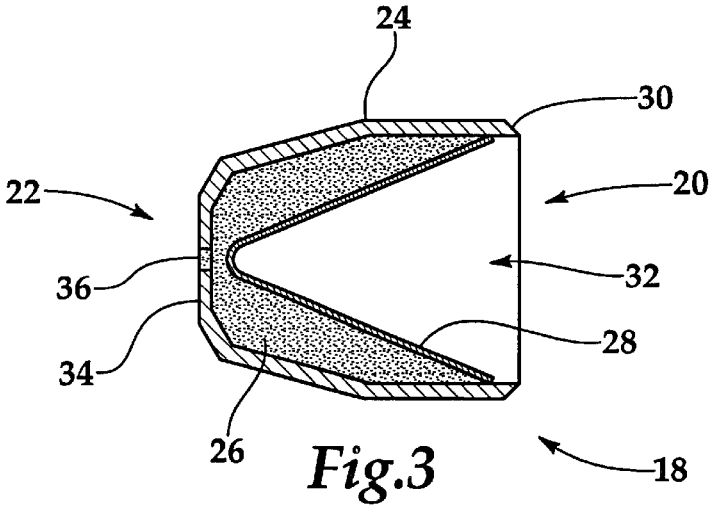
FIG. 3 is a cross-sectional view of the shaped charge of FIG. 2.

Forward openings 14 are sized to receive a shaped charge 18. A typical shaped charge 18 used with hollow carrier gun assemblies is shown in greater detail in FIGS. 2 and 3. The shaped charge 18 is of the type typically known as a basic charge used in a typical prior art reusable hollow carrier guns as discussed in the background section of this application. Such a basic charge as used in the present invention will typically not include the polymeric exterior cover and alignment washer (face plate). Shaped charge 18 has a forward end 20 and a rearward end 22. Case 24 defines a housing that houses shaped explosive 26 and cone 28 (FIG. 3). The shape of cone 28 will affect the configuration of the blast from shaped explosive 26 and may have any number of configurations as known in the art. Case 24 defines a rim 30 on forward end 20 of shaped charge 18. A front face 32 located on forward end 20 through which the blast is directed. Typically, rearward end 22 of shaped charge 18 tapers toward a rear face 34. Rear face 34 typically has a smaller diameter than front face 32. Rear face 34 has a center point 36 (FIG. 2). It will be understood by those skilled in the art that the shapes of the case for the charge may take any number of configurations and still be suitable for use with the present invention.

In a preferred embodiment, when installed within tube 12, at least a portion of rear face 34 of charge 18 may protrude slightly from rearward opening 16 of tube 12. In the preferred embodiment, rearward opening 16 should be sized such that opening 16 is slightly larger than the diameter of rear face 36 of shaped charge 18. Tabs 37 (FIG. 1) may be formed by cutting and bending a portion of tube 12 that surround forward opening 14 in tube 12. Tabs 37 function as a secondary device to retain shaped charge 18 within tube 12.

Referring back to FIG. 1, a detonating cord 38 wraps around tube 12 such that portions of detonating cord 38 are located in contact with the centerpoint 36 of rear face 34 of each shaped charge 18 that are installed within tube 12. It can be seen from FIG. 1 that at least a portion of rear face 34 of each shaped charge 18 is accessible through rearward opening 16 in tube 12.

Still referring to FIG. 1, a clip is located proximate each shaped charge 18 to secure shaped charge 18 within tube 12. As can be seen in greater detail in FIGS. 4–7, several embodiments of suitable clips are shown and described, although still other variations are possible and which fall within the scope of this invention. One embodiment is a two-wire clip 40 shown installed on tube 12 in FIG. 1 and shown uninstalled in FIGS. 4, 4*a* and 4*b*. Two-wire clip 40 is substantially semi-circular in shape and partially surrounds the outside surface of tube 12. Two-wire clip 40 has a front 42 having a gap 44 formed therein and a back 45 having a detonating cord retainer (hereinafter "retainer") 47 formed therein. Two-wire clip 40 terminates at a first end 46 and a second end 48 on either side of gap 44. A first hook 50 is formed on first end 46 and a second hook 52 is formed on second end 48. Hooks 50 and 52 are designed to grasp rim 30 of a shaped charge 18 when shaped charge 18 is installed within tube 12 (FIG. 1). Two-wire clip 40 is made up of first wire 54 and second wire 56. In one embodiment, retainer 47 is formed by a first wire 54 that has a first U-shaped portion 58 formed therein, which is side-by-side with a second U-shaped portion 60 formed in second wire 56. U-shaped retainer portions 58 and 60 form a channel for receiving and securing detonating cord 38 to the back 34 and centerpoint 36 of charge 18 when two-wire clip 40 is installed (FIG. 1). First U-shaped portion 58 may also be offset from second U-shaped portion 60 (FIG. 4*b*) to better accommodate the angled path of the detonating cord 38 with respect to the two-wire clip 40 due to the helical path of detonating cord 38 around the tube 12 (FIG. 1).

A second embodiment of a clip is band clip 62 (FIGS. 5, 5*a*, 5*b*). Band clip 62 is substantially semi-circular in shape and roughly conforms to the outside surface of tube 12. Band clip 62 has a front 64 having a gap 66 formed therein and a back 67. Band clip 62 terminates at a first end 68 and a second end 70 on either side of gap 66. A first hook 72 is formed in first end 68 and a second hook 74 is formed in second end 70. Hooks 72 and 74 are designed to grasp rim 30 of a shaped charge 18 when shaped charge 18 is installed within tube 12 (FIG. 1). Band clip 62 is made up of a flat band 76 of material such as metal or plastic or other suitable material. In one embodiment, flat band 76 has a retainer 47 that is a horizontal channel 78 formed in flat band 76 for receiving and securing detonating cord 38 when band clip 62 is installed (FIG. 1). It is preferable to taper the edges of horizontal channel 78 to reduce the possibility of cutting detonating cord 38 with the band clip 62. Band clip 62 may also have an angled channel 80 (FIG. 5*b*), which is angularly offset from longitudinal axis 63 (FIGS. 5*a*, 5*b*), to better accommodate the angled path of the detonating cord 38 with respect to the band clip 62 due to the helical path of detonating cord 38 with respect to the tube 12 (FIG. 1).

An additional embodiment of a clip is adjustable band clip 82 is shown in FIG. 6. Adjustable band clip 82 is similar to band clip 62 and therefore will retain the same numerical designations as band clip 62 for similar components. Adjustable band clip 82, however is made up of a first piece 84 and a second piece 86, each having a plurality of slots 87 formed thereon. A adjustment device 88, such as a screw mechanism commonly used on hose clamps, is provided to tighten adjustable band clip 82 as desired once adjustable band clip 82 is installed on tube 12 and on a shaped charge 18 that has been located within tube 12.

Figure 7:
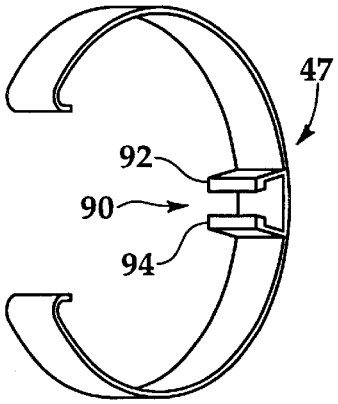
FIG. 7 is a perspective view of a retainer device on a clip.

Referring now to FIG. 7, retainer 47 is shown in the form of a snap device 90 that is provided on an inside surface of a clip. Snap device 90 may be installed on any of two-wire clip 40, band clip 62, or adjustable band clip 82. Snap device 90 is made of a first securing tab 92 and a second securing tab 94. Securing tabs 92, 94 are positioned such that securing tabs 92, 94 frictionally engage detonating cord 38 to secure detonating cord 38.

Figure 8:
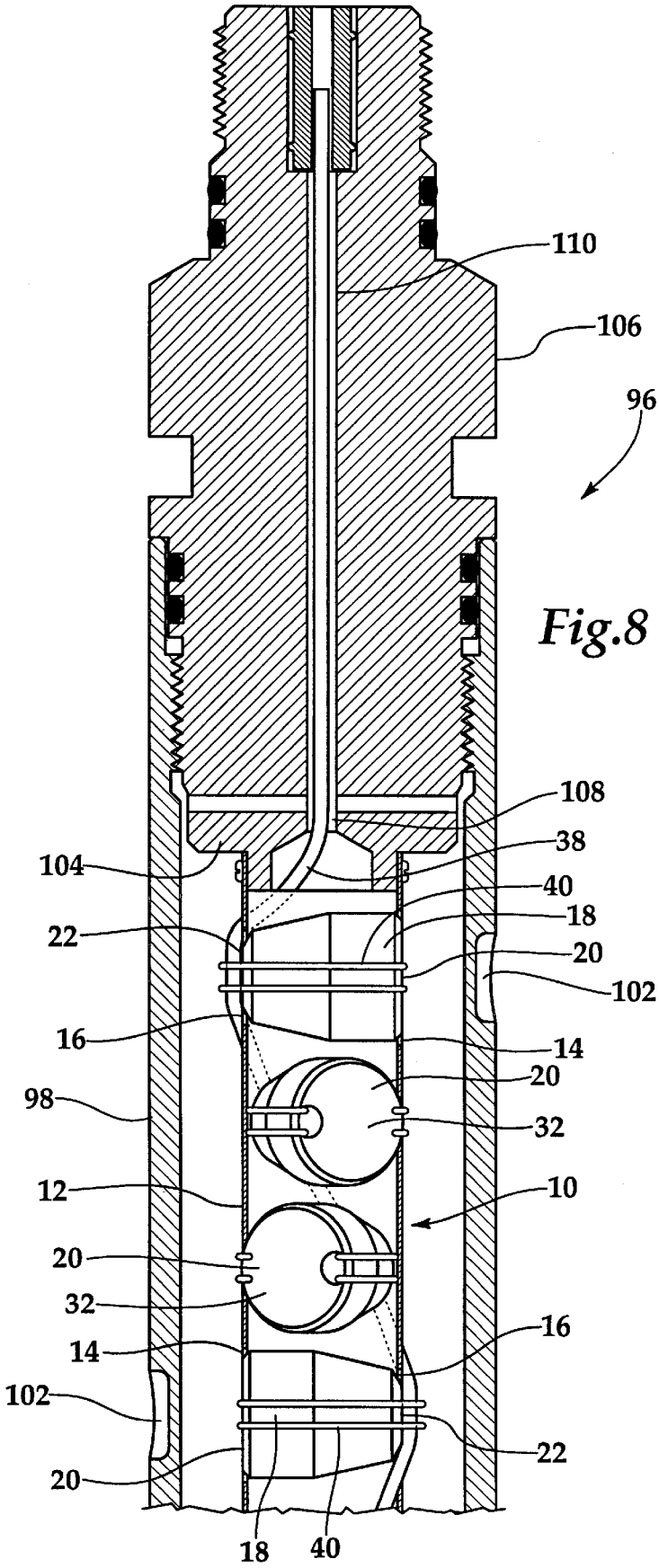
FIG. 8 is a partial cross-sectional view of the tubular charge holder assembly of the present invention installed within a hollow carrier gun assembly.

Referring now to FIG. 8, tubular charge holder assembly 10 is shown installed within prior art hollow carrier gun assembly 96. It will be understood by those skilled in the art that the hollow carrier assembly 96 illustrates in FIG. 8 is but one embodiment of a hollow carrier gun assembly with which the tubular charge holder assembly of the present invention may be used. Gun assembly 96 is made up of a hollow carrier 98 having an upper end 100. Hollow carrier 98 may be sized to receive tubular charge holder assembly 10 or conversely for a predetermined outside diameter of a hollow carrier 98, the tubular charge holder assembly 10 will be sized accordingly to be received inside the hollow carrier 98. Hollow carrier 98 may have areas of reduced thickness or scallops 102 formed on the wall of the hollow carrier 98. An alignment fixture 104 is affixed to a lower end of a cross-over piece 106. Cross-over piece 106 attaches to an upper end of tubular charge holder assembly 10. Cross-over piece 106 lands within cylindrical gun 98. Alignment fixture 104 attaches to an upper end of tubular charge holder assembly 10 to support tubular charge holder assembly 10. Alignment fixture 104 has a detonating cord passageway 108 for receiving detonating cord 38 therein. Similarly, cross-over piece 106 has a detonating cord passageway 110 for receiving detonating cord 38.

In practice, tubular charge holder assembly 10 is assembled by first optionally forming tabs 37 on the outside of forward openings 14 on tube 12. A shaped charge 18 is placed within each forward opening 14 of tube 12 as desired such that front face 32 extends out of forward opening 14 and rear face 34 extends out of rearward opening 16 of tube 12. Tabs 37 are then bent towards the center of forward opening 14 to secure shaped charge 18 within tube 12 (FIG. 1). Detonating cord 38 is then wrapped around a length of tube 12 such that detonating cord 38 traverses the rear face 34 of the shaped charges 18 that are installed within the various forward openings of tube 12 (FIG. 1). The detonating cord may be wrapped helically on the outside of the tube or run pass on the inside of the tube and pass outside the tube when disposed across the rear face of a charge.

A clip 40, 62, 82 (FIGS. 1 and 4–7) is then installed around tube 12 and detonating cord 38 to secure each shaped charge 18 within tube 12. Detonating cord 38 is located within U-shaped portion 58, 60, channel 78, 80 or snap device 90 (FIGS. 1 and 4–7) on clip 40, 62, 82. First hook 50, 72 is hooked over a portion of rim 30 of shaped charge 18. Second hook 52, 74 is then hooked over a second portion of rim 30 of shaped charge 18, thereby securing shaped charge 18 within tube 12 (FIG. 1). Clip 40, 62, 82 secures detonating cord 38 adjacent to center point 36 of rear face 34. By securing detonating cord 38 adjacent to center point 36, the chances of a misfire are greatly decreased as compared to prior art devices that allowed an air gap to be present between the detonating cord 38 and the rear face 34 of the shaped charge 18.

It will be appreciated by those skilled in the art that tabs 37 are not necessary for practice of the invention, but if used, provide redundant capacity for securing charge 18 in tube 12. It will also be understood by those skilled in the art that if tabs 37 are used, clips 40, 62 and 82 may be used to first secure charge 18 in place and then tabs 37 used to redundantly secure charge 18 in holder 12.

Once the tubular charge holder assembly 10 is assembled, detonating cord 38 is run through the detonating cord passageways 108 and 110 of the alignment fixture 104 and cross-over piece 106. The tubular charge holder assembly 10 is then affixed to alignment fixture 104, which is attached to crossover piece 106. The cross-over piece 106 and attached alignment fixture 104 and tubular charge holder 10 are then lowered and secured within a hollow carrier 98 (FIG. 8). If hollow carrier 98 has scallops 102 formed thereon, then alignment fixture 104 may be used to orient the tubular charge holder assembly such that the front faces 32 of the shaped charges 18 face the scallops 102 from within the hollow carrier 98.

Subsequently, other preparations known in the art are conducted and gun assembly 96 is lowered within a well bore. Detonating cord 38 is detonated, thereby activating shaped charges 18. A controlled explosion emanates from front face 32 of shaped charges 18, which perforate the hollow carrier 98, the well casing, and the surrounding formation (not shown) as is well known in the art.

The present invention has numerous advantages over the prior art. One advantage is that the clips 40, 62 and 82, which surround tube 12 rather than clip onto specially formed protuberances on the rear face of a shaped charge (as taught in the prior art), allow for the use of shaped charges 18 with flat backs 34 (without protuberances). Shaped charges having a flat rear surface rather than having a specially shaped protuberance are less expensive to manufacture. A side benefit is that shaped charges having flat rear surfaces are produced in abundance for use with reusable hollow carrier gun assemblies. The high volume of shaped charges produced having flat rear surfaces further contributes to the lower cost of such shaped charges. Previously, the shaped charges having a flat rear surface were only usable in reusable type hollow carrier gun assemblies (as discussed in the ground section of this application) because there was no easy and reliable method and device for securing a basic charge with no securing protuberance to an expendable tubular charge holder for use inside an expendable hollow carrier gun. A disadvantage of using the reusable hollow carrier gun assembly is that loading the reusable hollow carrier gun assemblies with the shaped charges requires a special tool and is very labor intensive. Prior art expendable tubular charge holder assemblies require shaped charges having protuberances on their rear face to provide a location to affix a small clip to secure the shaped charge within the tube and to locate the detonating cord proximate the rear face of the shaped charge. The invention of the applicant allows the use of less expensive flat backed shaped charges in combination with the less labor intensive expendable tubular charge holder assembly.

While the invention has been illustrated in several preferred embodiments, it should be apparent to those skilled in the art that it is not limited to the embodiments disclosed, but is susceptible to various changes without departing from the scope of the invention as claimed.

We claim:

1. A tubular charge holder assembly for a perforating gun comprising:

a tube having a plurality of forward openings and a plurality of corresponding rearward openings;

a plurality of shaped charges, each having a forward end and a rearward end, each of said shaped charges located within said tube and positioned such that said forward end is proximate to one of said forward openings and said rearward end is proximate to said corresponding rearward opening of said tube;

a detonating cord positioned proximate said rear end of the shaped charge; and a clip at least partially surrounding an exterior surface of said tube for securing said detonating cord to said tube.

2. The tubular charge holder assembly according to claim 1, wherein:

said detonating cord is wrapped around an exterior of said tube and positioned proximate said rearward end of each of said shaped charges.

3. The tubular charge holder assembly according to claim 1 wherein said clip further comprises:

a retainer for receiving and securing said detonating cord to the rear end of said shaped charge.

4. The tubular charge holder assembly according to claim 1 wherein:

said tube is comprised of metal.

5. The tubular charge holder assembly according to claim 1 wherein:

said tube is comprised of cardboard.

6. The tubular charge holder assembly according to claim 1 wherein:

said clip is comprised of a wire.

7. The tubular charge holder assembly according to claim 3 wherein:

said clip is comprised of a wire; and said retainer is a U-shaped portion.

8. The tubular charge holder assembly according to claim 1 wherein:

said clip is comprised of at least a first and a second of wire.

9. The tubular charge holder assembly according to claim 3 wherein:

said clip is comprised of at least a first and second wire;

said retainer is a first U-shaped portion on said first wire; and said retainer is a second U-shaped portion on said second wire.

10. The tubular charge holder assembly according to claim 9 wherein:

said first and said second U-shaped portions are side-by-side.

11. The tubular charge holder assembly according to claim 9 wherein:

said first and said second U-shaped portions are offset from one another.

12. The tubular charge holder assembly according to claim 1 wherein:

said clip is comprised of a band.

13. The tubular charge holder assembly according to claim 3 wherein:

said clip is comprised of a band and said retainer is a channel oriented perpendicular to a longitudinal axis of said band.

14. The tubular charge holder assembly according to claim 3 wherein:

said clip is comprised of a band and said retainer is a channel angularly offset from a longitudinal axis of said band.

15. The tubular charge holder assembly according to claim 1 wherein:

said clip is comprised of an adjustable band.

16. The tubular charge holder assembly according to claim 3 wherein:

said clip is comprised of an adjustable band; and said retainer is a channel oriented perpendicularly to a longitudinal axis of said band.

17. The tubular charge holder assembly according to claim 3 wherein:

said clip is comprised of an adjustable band; and said retainer is a channel angularly offset from a longitudinal axis of said band.

18. The tubular charge holder assembly according to claim 3 wherein:

said clip is comprised of an adjustable band; and said retainer is a U-shaped portion.

19. The tubular charge holder assembly according to claim 3 wherein:

said clip is comprised of an adjustable band; and said retainer is oriented perpendicularly to a longitudinal axis of said clip.

20. The tubular charge holder assembly according to claim 3 wherein:

said clip is comprised of an adjustable band; and said retainer is a angularly offset from a longitudinal axis of said clip.

21. The tubular charge holder assembly according to claim 3 wherein:

said retainer is a snap device.

22. The tubular charge holder assembly according to claim 3 wherein:

said retainer is a snap device; and said retainer is oriented perpendicularly to a longitudinal axis of said clip.

23. The tubular charge holder assembly according to claim 3 wherein:

said retainer is a snap device; and said retainer is angularly offset from said clip.

24. The tubular charge holder assembly according to claim 1, wherein:

said plurality of shaped charges and have a rear face on said rearward end; and said detonating cord secured in close proximity to a centerpoint of said rear face of said shaped charge.

25. A method of securing a detonating cord of a tubular charge holder for a perforating gun comprising the steps of:

wrapping a detonating cord around a tube;

installing a clip at least partially around an exterior surface of said tube such that said detonating cord is secured between said clip and at least a portion of said exterior surface of said tube.

26. The method of claim 25 further comprising the steps of:

positioning said detonating cord proximal to a rear face of a said shaped charge;

locating said clip across said detonating cord, said clip having a retainer formed thereon;

locating said detonating cord within said retainer on said clip; and securing said detonating cord proximate said rear face of said shaped charge with said clip.

27. The method of claim 26 further comprising the step of:

positioning said clip such that said detonating cord is positioned proximate a centerpoint of said rear face of said shaped charge.

28. A clip for securing a detonating cord to a tubular charge holder used in a perforating gun, said clip comprising:

a substantially semi-circular body, said body at least partially surrounding an exterior surface of said tubular charge holder; and a retainer formed on said body, said retainer sized to secure said detonator cord at a desired location on said tube.

29. A tubular charge holder assembly for a perforating gun comprising:

a tube having a plurality of forward openings and a plurality of corresponding rearward openings;

a plurality of shaped charges, each having a forward end and a rearward end and each of said shaped charges located within said tube and positioned such that said forward end is proximate to one of said forward openings and said rearward end is proximate to said corresponding rearward opening of said tube; and a clip at least partially surrounding an exterior surface of said tube and positioned proximate each of said shaped charges for securing each of said shaped charges within said tube.

30. The tubular charge holder assembly according to claim 29, further comprising:

a detonating cord wrapped around an exterior of said tube and positioned proximate said rearward end of the shaped charge.

31. The tubular charge holder assembly according to claim 29, wherein:

said shaped charge has a forward rim on said forward end and a rear face on said rearward end; and said clip has a first end that affixes to a first portion of said forward rim of said shaped charge and a second end that affixes to a second portion of said forward rim of said shaped charge.

32. The tubular charge holder assembly according to claim 30 wherein said clip further comprises:

a retainer for receiving and securing said detonating cord.

33. The tubular charge holder assembly according to claim 29 wherein:

said tube is comprised of metal.

34. The tubular charge holder assembly according to claim 29 wherein:

said tube is comprised of cardboard.

35. The tubular charge holder assembly according to claim 29 wherein:

said clip is comprised of a wire.

36. The tubular charge holder assembly according to claim 29 wherein:

said clip is comprised of at least a first and a second of wire.

37. The tubular charge holder assembly according to claim 29 wherein:

said clip is comprised of a band.

38. The tubular charge holder assembly according to claim 29 wherein:

said clip is comprised of an adjustable band.

39. A method of securing a shaped perforating charge within a tube comprising the steps of:

positioning a shaped charge within a tube such that a rim of a front face of said shaped charge extends at least partially out of a forward opening of said tube and a rear face of said shaped charge extends at least partially out from a rear opening of said tube; and installing a clip at least partially around an exterior surface of said tube for securing said shaped charge within said tube.

40. The method of claim 39 further including the steps of:

affixing a first end of said clip to a first portion of the rim of said shaped charge; and affixing a second end of said clip to a second portion of the rim of said shaped charge to secure said shaped charge within said tube.

41. The method of claim 39 further including the steps of:

positioning a detonating cord proximate to the rear face of a said shaped charge;

locating said detonating cord within a retainer on said clip; and securing said detonating cord proximate said rear face of said shaped charge.

42. A clip for holding a shaped perforating charge, said charge having a forward rim on a forward end and a rear face on a rearward end of said shaped charge, within a tubular charge holder used in a perforating gun, said tubular charge holder having a plurality of forward openings and a plurality of corresponding rearward openings, wherein each of said forward openings is larger than each of said rearward openings, such that said forward rim is proximate to a forward opening and said rear face is proximate to a rearward opening in said tubular charge holder, and for securing a detonator cord to a rear face of a perforating charge, said clip comprising:

a substantially semi-circular body at least partially surrounding an exterior surface of said tubular charge holder and positioned proximate said shaped charge;

said body having a first end that affixes to a first position on a forward rim of said shaped charge and a second end that affixes to a second position on said forward rim of said shaped charge.

43. A tubular charge holder assembly for a perforating gun comprising:

a tube having a plurality of forward openings and a plurality of corresponding rearward openings;

a plurality of shaped charges, each having a forward end and a rearward end, said rearward end having a rear face, each of said shaped charges located within said tube and positioned such that said forward end is proximate to one of said forward openings and said rearward end is proximate to said corresponding rearward opening of said tube;

a detonating cord positioned proximate said rearward face of the shaped charge; and a clip at least partially surrounding an exterior surface of said tube and positioned proximate each of said shaped charges for aligning said detonating cord with said rear face of each of said shaped charges within said tube.

44. The tubular charge holder assembly according to claim 43, wherein:

said detonating cord is wrapped around an exterior of said tube and positioned proximate said rearward end of the shaped charge.

45. The tubular charge holder assembly according to claim 43, wherein:

said shaped charge has a forward rim on said forward end and a rear face on said rearward end; and said clip has a first end that affixes to a first portion of said forward rim of said shaped charge and a second end that affixes to a second portion of said forward rim of said shaped charge.

46. The tubular charge holder assembly according to claim 43 wherein said clip further comprises:

a retainer for receiving and securing said detonating cord to the rear face of said shaped charge.

47. The tubular charge holder assembly according to claim 43 wherein:

said tube is comprised of metal.

48. The tubular charge holder assembly according to claim 43 wherein:

said tube is comprised of cardboard.

49. The tubular charge holder assembly according to claim 43 wherein:

said clip is comprised of a wire.

50. The tubular charge holder assembly according to claim 46 wherein: said clip is comprised of a wire; and said retainer is a U-shaped portion.

51. The tubular charge holder assembly according to claim 43 wherein:

said clip is comprised of at least a first and a second wire.

52. The tubular charge holder assembly according to claim 46 wherein:

said clip is comprised of at least a first and second wire;

said retainer is a first U-shaped portion on said first wire; and said retainer is a second U-shaped portion on said second wire.

53. The tubular charge holder assembly according to claim 52 wherein:

said first and said second U-shaped portions are side-by-side.

54. The tubular charge holder assembly according to claim 52 wherein:

said first and said second U-shaped portions are offset from one another.

55. The tubular charge holder assembly according to claim 43 wherein:

said clip is comprised of a band.

56. The tubular charge holder assembly according to claim 46 wherein:

said clip is comprised of a band and said retainer is a channel oriented perpendicular to a longitudinal axis of said band.

57. The tubular charge holder assembly according to claim 46 herein:

said clip is comprised of a band and said retainer is a channel angularly offset from a longitudinal axis of said band.

58. The tubular charge holder assembly according to claim 43 wherein:

said clip is comprised of an adjustable band.

59. The tubular charge holder assembly according to claim 46 wherein:

said clip is comprised of an adjustable band and said retainer is a channel oriented perpendicularly to a longitudinal axis of said band.

60. The tubular charge holder assembly according to claim 46 wherein:

said clip is comprised of an adjustable band and said retainer is a channel angularly offset from a longitudinal axis of said band.

61. The tubular charge holder assembly according to claim 46 wherein:

said clip is comprised of an adjustable band; and said retainer is a U-shaped portion.

62. The tubular charge holder assembly according to claim 46 wherein:

said clip is comprised of an adjustable band; and said retainer is oriented perpendicularly to a longitudinal axis of said clip.

63. The tubular charge holder assembly according to claim 46 wherein:

said clip is comprised of an adjustable band; and said retainer is angularly offset from a longitudinal axis of said clip.

64. The tubular charge holder assembly according to claim 46 wherein:

said retainer is a snap device.

65. The tubular charge holder assembly according to claim 46 wherein:

said retainer is a snap device; and said retainer is oriented perpendicularly to a longitudinal axis of said clip.

66. The tubular charge holder assembly according to claim 46 wherein:

said retainer is a snap device; and said retainer is angularly offset from said clip.

67. The tubular charge holder assembly according to claim 43, wherein:

said detonating cord is secured in close proximity to a centerpoint of said rear face of said shaped charge.

68. A method of aligning a detonating cord with a rear face of a detonating charge comprising the steps of:

positioning a shaped charge within a tube such that a rim of a front face of said shaped charge extends at least partially out of a forward opening of said tube and a rear face extends at least partially out of a rear opening of said tube;

positioning a detonating cord proximate to the rear face of a said shaped charge;

locating said detonating cord within a retainer on a clip; and positioning said clip on said tube at least partially surrounding said tube such that said detonating cord is located proximate said rear face of said shaped charge.

69. The method of claim 68 further including the steps of:

affixing a first end of said clip to a first portion of the rim of said shaped charge;

affixing a second end of said clip to a second portion of the rim of said shaped charge to secure said shaped charge within said tube.

70. The method of claim 68 further including positioning said clip such that said detonating cord is positioned proximate a centerpoint of said rear face of said shaped charge.

* * * * *